US010253516B2

(12) United States Patent
Dershem

(10) Patent No.: US 10,253,516 B2
(45) Date of Patent: Apr. 9, 2019

(54) POOL COVER SPRING AND METHOD OF USE

(71) Applicants: Jeffrey L. Dershem, Zionsville, PA (US); Deborah L. Dershem, Zionsville, PA (US)

(72) Inventor: Jeffrey L. Dershem, Zionsville, PA (US)

(73) Assignees: Jeffrey L. Dershem, Zionsville, PA (US); Deborah L. Dershem, Zionsville, PA (US)

( * ) Notice: Subject to any disclaimer, the term of this patent is extended or adjusted under 35 U.S.C. 154(b) by 0 days.

(21) Appl. No.: 15/134,589

(22) Filed: Apr. 21, 2016

(65) Prior Publication Data

US 2017/0307048 A1 Oct. 26, 2017

(51) Int. Cl.
*E04H 4/14* (2006.01)
*E04H 4/06* (2006.01)

(52) U.S. Cl.
CPC ..... *E04H 4/14* (2013.01); *E04H 4/06* (2013.01)

(58) Field of Classification Search
CPC ..... Y10T 24/4764; Y10T 24/314
USPC ..... 4/503; 267/71; 24/265 AL
See application file for complete search history.

(56) References Cited

U.S. PATENT DOCUMENTS 2,192,946 A 3/1940 Towner
2,958,872 A 11/1960 Meyer, Jr.
3,203,067 A 8/1965 Elsner
3,264,656 A 8/1966 Clay et al.
3,382,549 A 5/1968 Price
3,467,085 A 9/1969 Cormier
3,653,652 A * 4/1972 Lindberg, Jr. ..... F16F 1/128 267/178
3,905,610 A 9/1975 Dini
4,094,021 A 6/1978 Rapp
4,817,551 A 4/1989 Matson
5,253,393 A 10/1993 Levin
5,608,926 A 3/1997 Donaton
5,800,089 A 9/1998 Donaton
6,158,374 A * 12/2000 Free, Jr. ..... B63B 21/00 114/215
D552,456 S 10/2007 Selby
7,805,816 B1 * 10/2010 Thorne, III ..... B60P 7/0807 24/265 H
7,971,269 B2 7/2011 Buckley
2005/0273985 A1 * 12/2005 Tsai ..... A44B 11/006 24/302
2006/0209533 A1 9/2006 Druzin
2009/0100646 A1 4/2009 Wang
2010/0135024 A1 * 6/2010 Gier ..... F21V 3/02 362/294
2012/0278987 A1 * 11/2012 Marelli ..... E04H 4/10 4/503
2015/0074953 A1 3/2015 Dershem
2015/0196795 A1 7/2015 Kristiansen
2015/0211591 A1 7/2015 Marelli

* cited by examiner

*Primary Examiner* — Lauren Crane
(74) *Attorney, Agent, or Firm* — Clark & Brody

(57) ABSTRACT

A pool cover spring includes a one piece molded spring body having a narrowed midsection, an end with a connector for attaching to a pool deck anchor and another end with slots for receiving a strap of a pool cover.

10 Claims, 3 Drawing Sheets

POOL COVER SPRING AND METHOD OF USE

FIELD OF THE INVENTION

The present invention is directed to a pool cover spring and, in particular, to a one piece molded body having ends respectively configured to attach to a pool deck anchor and straps from a pool cover.

BACKGROUND ART

Pool cover springs are well known in the pool industry. These springs use a metallic bent wire spring mechanism, one end configured to connect to an anchor on a pool deck and the other end configured to connect to a strap of a pool cover. These springs are expensive, can cause a tripping hazard when walking on the pool deck, and can cause physical marring damage to the pool deck during spring activation.

SUMMARY OF THE INVENTION

It is a first object of the invention to provide an improved pool cover spring with simple method of use and made of a material(s) that will not cause physical marring damage to the pool deck; and will withstand environmental exposure.

A further object of the invention to provide a pool cover spring that has a low profile, is inexpensive to make, and optionally can be made to glow in the dark to avoid tripping.

One embodiment of the invention includes a spring body that has a first end, second end, and mid-section between the first and second ends. The second end includes a plurality of slots transversely configured with respect to a longitudinal direction of the spring body to receive a strap of a pool cover. The midsection has a cross section smaller than the first and second ends. The spring body is a one piece molded body with the plurality of slots molded into the spring body.

A connector is also included and associated with the first end. The connector is designed to attach to an anchor of a pool deck. The connector is integrally molded into the first end of the spring body. The connector can be any type of a structure that creates an opening to receive the pool deck anchor and examples include a ring, e.g., a d-ring, a circular ring and the like.

In one embodiment, the spring body can be made so that it has glow in the dark capability.

While any molding can be used to make the spring body, injection molding is preferred.

Exemplary materials to be molded into the spring body could include elastomeric compounds of gum rubber, epdm rubber, silicone, silicone vulcanate, thermal cast urethane and extruded/injection molded-thermal plastic urethane.

The pool spring cover can also be molded with a flat underside surface to facilitate it resting on a flat pool deck. The spring body can be molded with a solid construction or molded with cavities in, the cavities formed in an underside of the spring body for material savings. The cavities can be formed by ridges that extend longitudinally, transversely, and obliquely in the ends to enhance strength thereof and formed by ridges running longitudinally along the spring body to enhance the stretching of the mid-section during use.

The invention also include a method of attaching straps of a pool cover to anchors in a pool deck, the improvement comprising using the pool cover spring of claim 1 and attaching the connector to the anchor and the strap to the slots in the second end of the spring body and tensioning the pool cover spring to keep the pool cover in place.

BRIEF DESCRIPTION OF THE DRAWINGS

Reference is now made to the drawings of the invention wherein.

DESCRIPTION OF THE PREFERRED EMBODIMENTS

Figure 1:
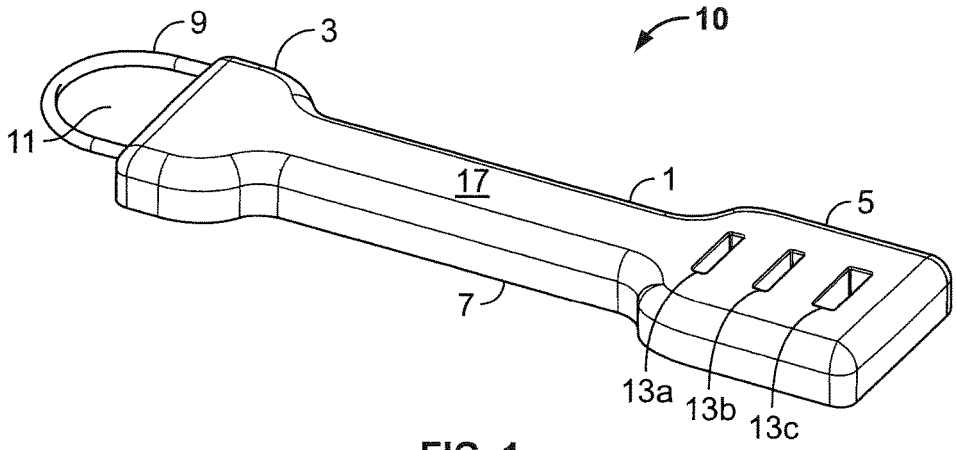
FIG. 1 is shows a top perspective view of one embodiment of the inventive pool cover spring.
Figure 2:
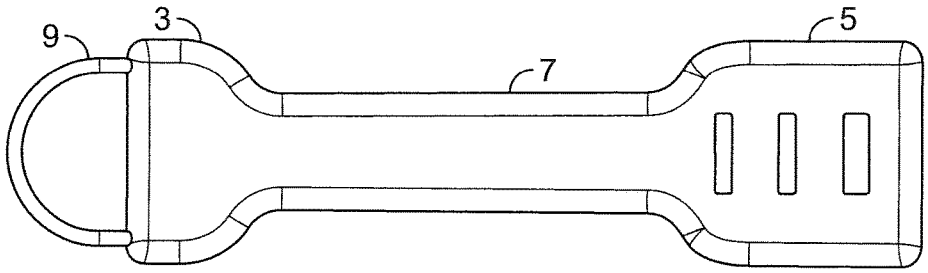
FIG. 2 shows a top plan view of the pool cover spring of FIG. 1.

The invention provides an improved pool cover spring. The pool cover spring is inexpensive to make and has a low profile to minimize tripping and made of materials as to not cause physical marring damage to the pool deck.

Referring to FIGS. 1-5, one embodiment of the pool spring cover is designated by the reference numeral 10. The pool spring cover 10 has a spring body 1, the body 1 having a pair of opposing ends 3 and 5 that are connected together with a reduced size midsection 7. The end 3 includes a molded-in connector 9, which is a d-ring in this embodiment. The connector 9 forms an opening 11 with the end 3 that is sized to hook onto a pool deck anchor (not shown). While a d-ring 9 is shown, any type of connector could be used that would be able to be securely attached to the anchor on a pool deck, a hook, a circular ring, or the like and be molded with the spring body 1.

The other end 5 of the spring body 1 has a plurality of slots 13*a*, 13*b*, and 13*c* running transverse to a longitudinal direction of the spring body 1. The slots 13*a-c* are spaced apart and sized to receive the strap of a pool cover. The strap passes through the slots 13*a-c* and is pulled/length adjusted to tension the pool cover. At least three slots 13*a-c* are needed to assist in connecting the strap to the spring 10 in order to alleviate an additional metal buckle currently required when using the traditional bent metal spring and is instrumental in accommodating streamlining the pool cover strapping by allowing for the insertion of the tag end of the strap into the double wide third slot 13*c*; the embodiment of FIG. 1 shows the three slots 13*a-c*. If the pool cover spring is used with a strap using the conventional metal buckle, two slots could be used.

The midsection 7 is made with a smaller cross section than either of the ends 3 and 5 so that the midsection 7 will preferentially stretch once the pool cover spring 10 is attached between a pool cover and an anchor and tensioned.

The spring body 1 can be made by molding it into a one piece part. The connector 9 is a metal material and is integrally molded into the spring body 1 during the molding process.

The material of the spring can be any type of a moldable and elastic material. Examples include elastomeric compounds of gum rubber, epdm rubber, silicone, silicone vulcanate, thermal cast urethane and extruded/injection molded-thermal plastic urethane.

The molding process can be any known process, with injection molding or thermal cast molding being preferred. In the embodiment of FIGS. 1-6, the spring body 1 is made so that an underside 15, see FIG. 3, can lay flat on a flat surface such as a pool deck.

Figure 3:
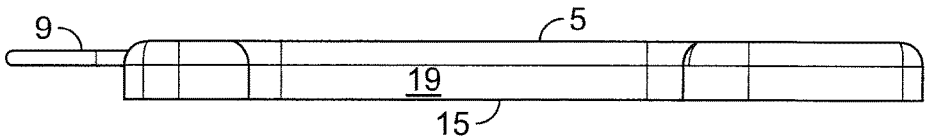
FIG. 3 shows a side view of the pool cover spring of FIG. 1.

Referring to FIGS. 1 and 3, the spring body 1 can be molded with solid surfaces 17 and 19 for the top and sides.

Figure 4:
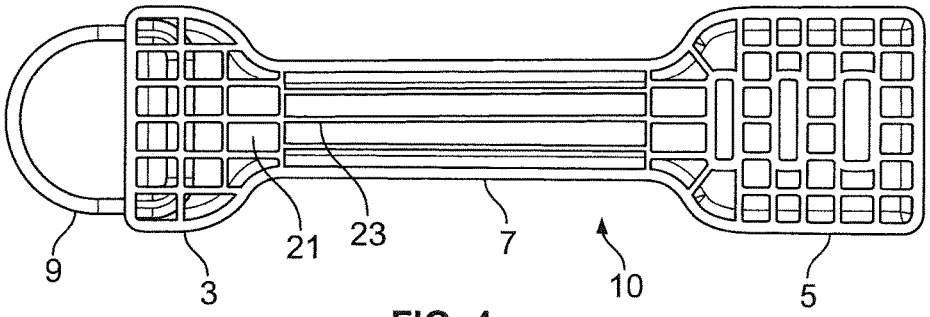
FIG. 4 is a bottom view of the pool cover spring of FIG. 1.
Figure 5:
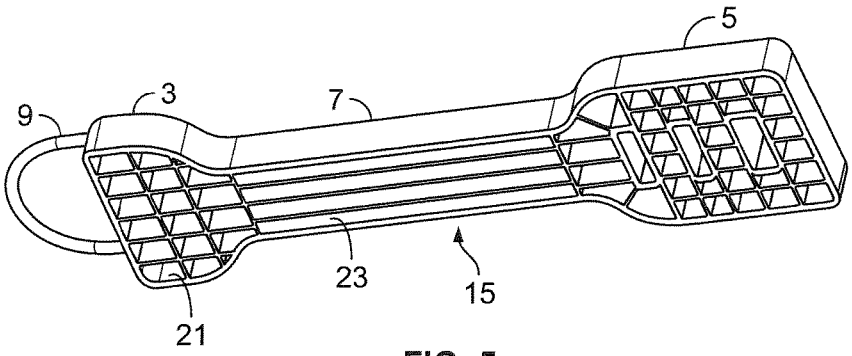
FIG. 5 is a bottom perspective view of the pool cover spring of FIG. 1.

Referring to FIGS. 4 and 5, the spring body 1 is molded with the underside 15 comprising a number of cavities 21 and ridges 23. The ridges 23 run transversely, longitudinally, and obliquely and interconnect to form the various cavities 21 in the underside 15 of the spring body 1. The cavities 21 perform a material savings function for the molding process and/or could be alleviated for a solid molded part. The ridges 23 in the midsection 7 run longitudinally to assist in the stretching that the midsection sees when the pool cover spring 10 is tensioned. The ridges 23 in the ends 3 and 5 run longitudinally, obliquely, and transversely to provide the ends 3 and 5 with more rigidity and less elasticity so as to handle the connection to the anchor and pool cover strap.

Figure 6:
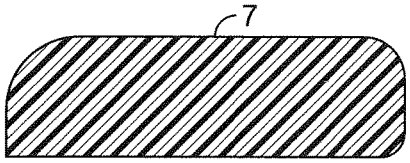
FIG. 6 is a cross sectional view along a midsection of a second embodiment of the pool cover spring.

The spring body 1 can be molded either as a solid piece or one that has cavities on the underside for the benefits noted above. The top surface 17 could also be molded in a non-smooth surface for aesthetic effect or to enhance gripping. FIG. 6 shows a cross sectional view along the midsection 7' of a spring body that is molded in a solid configuration.

The spring body 1 can be molded with glow in the dark compounds so that the pool cover spring 10 can be more easily seen at nighttime and becomes less of a tripping hazard. As the compounds and the technique of incorporating them into molded components are well known, a further description of this aspect of the invention is not necessary for understanding of the invention. The spring body 1 can also be molded in different colors as well.

Figure 7:
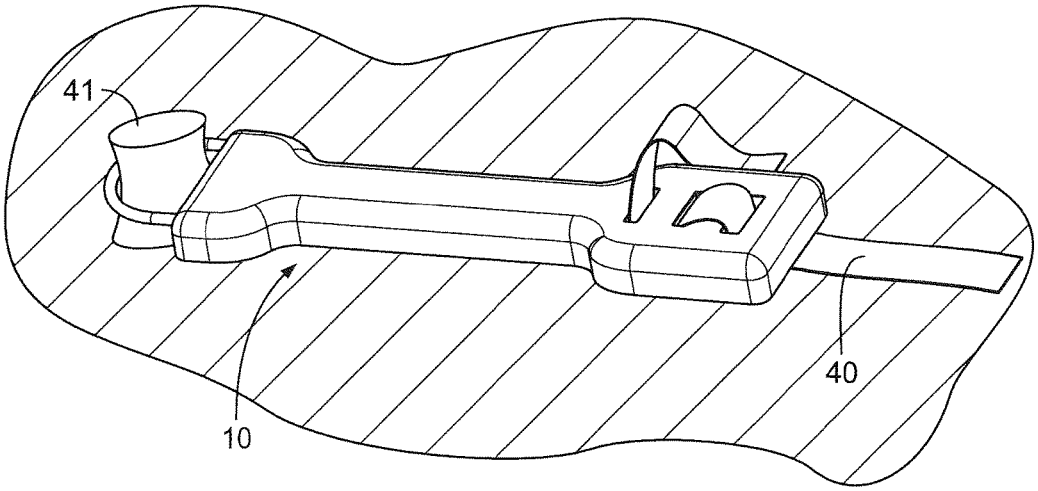
FIG. 7 shows the pool spring cover engaged with a pool deck anchor and pool cover strap.

In use, strategically placed around the entire perimeter of the pool cover and with reference to FIG. 7, a strap 40 from a pool cover (not shown) is first threaded through the slots 13 to the extent that the pool cover spring 10 is close to but not able to have the connector 9 slip over an anchor 41 of a pool deck. The pool spring is attached to the pool deck anchor 41 by sliding the connector 9 onto a conventional notched end lever-arm pipe, the lever-arm pipe is then placed over the pool deck anchor post 41 and the lever-arm pipe is levered toward the anchor post 41 to activate (stretch) the pool cover spring, thus lengthening the pool cover spring as the connector 9 is slid down the lever-arm pipe and over the anchor post 41. Repeating this process around the perimeter of the pool cover tensions the cover in place. To remove, the anchor 41 can be removed from the pool deck so as to release the tension or the notched lever-arm pipe maybe use in the reverse manner of attachment.

Alternatively, the connector 9 can be first slipped onto an anchor and then the strap 40 is attached to the spring body end 5 and pulled to tension the pool cover spring. Another mode of use would be to attach the connector to the anchor while the strap is attached to the end 5 and then tension the pool cover spring.

As such, an invention has been disclosed in terms of preferred embodiments thereof which fulfills each and every one of the objects of the present invention as set forth above and provides a new and improved pool cover spring and method of use.

Of course, various changes, modifications and alterations from the teachings of the present invention may be contemplated by those skilled in the art without departing from the intended spirit and scope thereof. It is intended that the present invention only be limited by the terms of the appended claims

What is claimed is:

1. A pool cover spring comprising:

a spring body, the spring body further comprising a first end, a second end including a plurality of slots transversely configured with respect to a longitudinal direction of the spring body to receive a strap of a pool cover; and a midsection extending between the first and second ends, the midsection having a cross section smaller than the first and second ends; wherein the spring body is a one piece molded body with the plurality of slots molded into the spring body; and a connector configured to attach to an anchor of a pool deck and integrally molded into the first end of the spring body, wherein the second end includes a free end that has an end face with a cross section larger than the cross section of the midsection;

wherein the second end further comprises a solid molded body including the end face of the free end, a portion of the solid molded body portion extending between one of the plurality of slots adjacent to the end face and the end face.

2. The pool spring cover of claim 1, wherein the spring body has glow in the dark capability.

3. The pool spring cover of claim 1, wherein the connector is a ring.

4. The pool spring cover of claim 1, wherein the spring body is made by injection or thermal cast molding.

5. The pool spring cover of claim 1, wherein the pool spring body is made from elastomeric compounds selected from the group consisting of gum rubber, epdm rubber, silicone, silicone vulcanate, thermal cast urethane and extruded/injection molded-thermal plastic urethane.

6. A pool cover spring comprising:

a spring body, the spring body further comprising a first end, a second end including a plurality of slots transversely configured with respect to a longitudinal direction of the spring body to receive a strap of a pool cover; and a midsection extending between the first and second ends, the midsection having a cross section smaller than the first and second ends; wherein the spring body is a one piece molded body with the plurality of slots molded into the spring body; and a connector configured to attach to an anchor of a pool deck and integrally molded into the first end of the spring body, wherein the pool spring body has a flat underside surface.

7. The pool spring cover of claim 6, wherein the pool spring body further comprises a plurality of spaced-apart ridges with cavities formed in the pool spring body and between the spaced-apart ridges, faces of the spaced-apart ridges forming part of the flat underside surface of the pool spring body.

8. In a method of attaching a plurality of straps of a pool cover to anchors in a pool deck, the improvement comprising using a pool cover spring comprising a spring body, the spring body further comprising a first end, a second end including a plurality of slots transversely configured with respect to a longitudinal direction of the spring body to receive a strap of a pool cover; and a midsection extending between the first and second ends, the midsection having a cross section smaller than the first and second ends; wherein the spring body is a one piece molded body with the plurality of slots molded into the spring body; and a connector configured to attach to an anchor of a pool deck and integrally molded into the first end of the spring body, wherein the second end further comprises a solid molded body including the end face of the free end, a portion of the solid molded body portion extending between one of the plurality of slots adjacent to the end face and the end face, and attaching the connector to the anchor and one of the plurality of straps to the slots in the second end of the spring body and tensioning the pool cover spring to keep the pool cover in place.

9. The pool spring cover of claim 1, wherein the slots are rectangular slots.

10. The pool spring cover of claim 6, wherein the flat underside surface extends from the first end to the second end.

* * * * *